US011278062B2

(12) United States Patent
Jones et al.

(10) Patent No.: US 11,278,062 B2
(45) Date of Patent: Mar. 22, 2022

(54) NOTCH FOR HOLDING POCKET SQUARE

(71) Applicants: Pedro Jones, Charleston, SC (US); Kasheena Jones, Charleston, SC (US); Kristian Jones, Charleston, SC (US)

(72) Inventors: Pedro Jones, Charleston, SC (US); Kasheena Jones, Charleston, SC (US); Kristian Jones, Charleston, SC (US)

( * ) Notice: Subject to any disclaimer, the term of this patent is extended or adjusted under 35 U.S.C. 154(b) by 0 days.

(21) Appl. No.: 16/138,963

(22) Filed: Sep. 21, 2018

(65) Prior Publication Data

US 2020/0093191 A1 Mar. 26, 2020

(51) Int. Cl.
*A41B 15/02* (2006.01)

(52) U.S. Cl.
CPC ..... *A41B 15/02* (2013.01)

(58) Field of Classification Search
CPC ..... A44B 15/02; Y10T 24/1376
See application file for complete search history.

(56) References Cited

U.S. PATENT DOCUMENTS 2,269,511 A * 1/1942 Biederman ..... A41B 15/02 2/279
2,379,092 A * 6/1945 Maschoff ..... A41B 15/02 24/3.5
2,513,884 A * 7/1950 Maurer ..... A41B 15/02 2/279
3,135,967 A * 6/1964 Stephens ..... A41B 15/02 2/279
3,786,520 A * 1/1974 Harmon ..... A41B 15/02 2/279
7,107,627 B2 * 9/2006 Holland ..... A41B 15/02 2/247
8,347,417 B1 * 1/2013 Chur ..... A41B 15/02 2/243.1
9,750,286 B1 * 9/2017 Wold ..... A41B 15/00
2007/0113323 A1 * 5/2007 Groves ..... A41B 15/02 2/279
2015/0096110 A1 * 4/2015 Guvenc ..... A41B 15/02 2/279

* cited by examiner

*Primary Examiner* — Robert Sandy
*Assistant Examiner* — Rowland Do
(74) *Attorney, Agent, or Firm* — Dunlap Bennett & Ludwig, PLLC

(57) ABSTRACT

A pocket square holder is provided. The holder is a plate that is rectangular though the midportion with distal and proximal ends that are wider than the midportion thereby defining a notched midportion. An elastic band circumscribes the midportion for removably securing a lower portion of a pocket square. Another band removably connects to the proximal end, as opposed to circumscribing, for tapering an upper portion of the pocket square that would protrude through a pocket of an upper garment that the pocket square was operatively associated with.

1 Claim, 4 Drawing Sheets

NOTCH FOR HOLDING POCKET SQUARE

BACKGROUND OF THE INVENTION

The invention relates to pocket squares, and more particularly, to a convenient notch for holding and maintaining the position of a pocket square.

Often, pocket square wearers struggle with the proper positioning of the pocket square in their pockets. Further, the pocket square may not stay in position, thus requiring them to reposition it, likely in a social setting.

There is a need for a convenient device which holds and maintains the position of a pocket square in the pocket.

DETAILED DESCRIPTION OF THE INVENTION

The following detailed description is of the best currently contemplated modes of carrying out exemplary embodiments of the invention. The description is not to be taken in a limiting sense, but is made merely for illustrating the general principles of the invention, since the scope of the invention is best defined by the appended claims.

As stated above, pocket square wearers struggle with the antagonizing repositioning of the pocket square during wear. The invention claimed here solves this problem.

The claimed invention is a notch that prevents the pocket square from sagging/dropping into a breast pocket by its outline and elastic attachments, which maintain the square in place.

The claimed invention differs from what currently exists. The notch is light, flexible, and durable in its usage. It can be manufactured in varying sizes to coincide with different sizes of breast pockets and pocket squares. Advantageously, the notch can be used by men, women, and children. In addition, the varying size (3) of the notch affords the wearer the opportunity to accommodate different size of pocket square currently manufactured.

Embodiments of various sizes of the notch are shown in FIGS. 1-10. The notch includes a pocket square holder 16, which is a rectangular piece with a wider proximal and distal end. The holder 16 can be made of polycarbonate, polyvinyl chloride acetate (PVCA), durable paper products, thermoplastics, or any suitable and sturdy material. The notch serves as a base to which a pocket square 12 is attached to with about two elastics.

Figure 4:
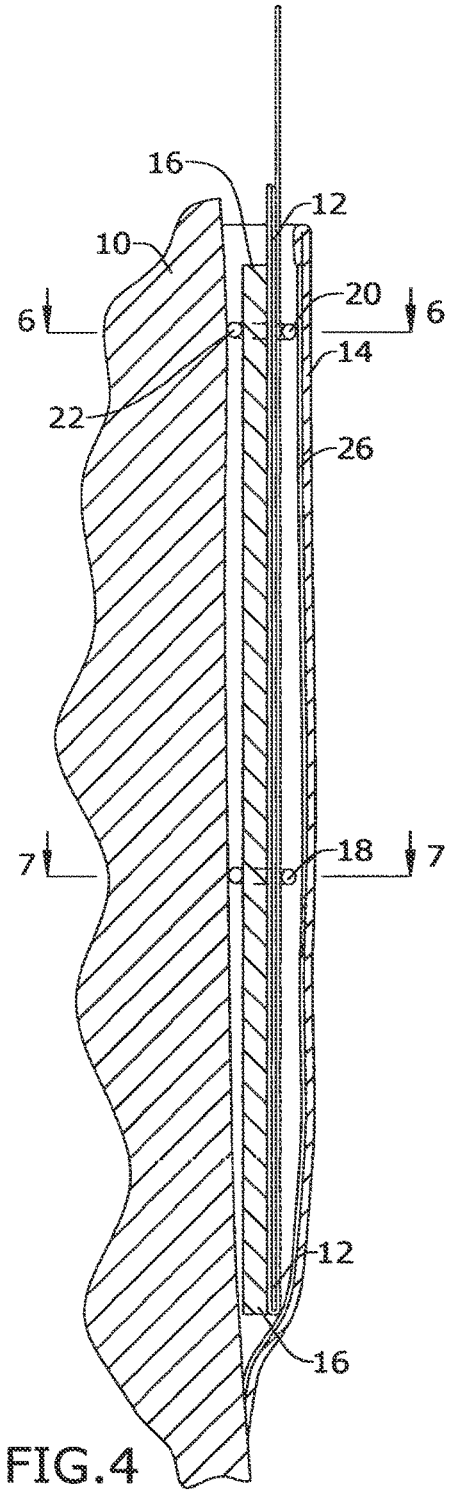
FIG. 4 shows a section view of an embodiment of the notch, taken along line 4-4 in FIG. 1.
Figure 5:
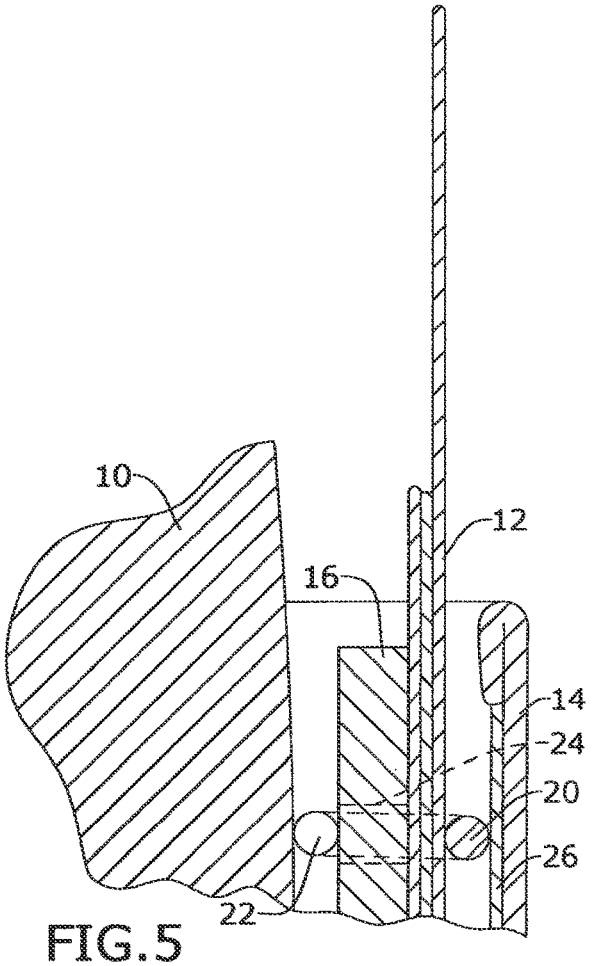
FIG. 5 is a detailed section view of the notch.

As shown in the embodiment of FIG. 4, the notch includes a proximal elastic band 20. The proximal band 20 can be attached across the proximal portion of the notch with barbs. A barb 22 is attached to each end of a piece of the proximal elastic band 20. Each barb 20 is pushed through an eyelet 24 on each side of the proximal portion of the notch to hold the band 20 in place. Alternatively, the band 20 can be heat sealed or attached to the notch by any suitable means.

The notch also includes a second elastic band 18 on a lower portion of the notch. This is a free moving rubber band that encircles that portion of the notch. It should be understood that the proximal band 20 and distal band 18 can both be free moving or attached to the notch.

Figure 6:
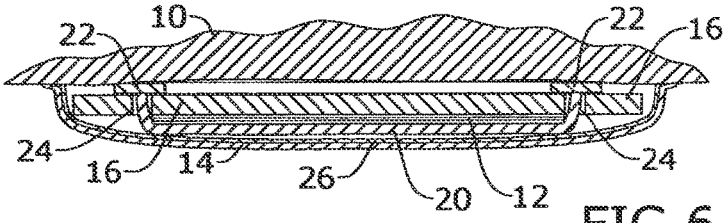
FIG. 6 is a section view of the notch, taken along line 6-6 in FIG. 4.

In one embodiment, the notch is used as the device to which the pocket square 12 is supported/attached wherein one end of the proximal band can be freed, or not attached to the notch with the barb 22 through the eyelet 24, so that the proximal band 20 can be wrapped about the pocket square 12. FIG. 6 shows an image of the back of the notch with both barbs 22 positioned through the eyelet 24.

Figure 7:
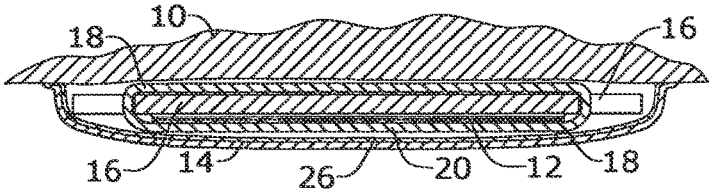
FIG. 7 is a section view of the notch, taken along line 7-7 in FIG. 4.

The embodiment of FIG. 7 shows a pocket square 12 positioned on the notch. The proximal band 20 is fastened around a portion of the pocket square 12 by inserting the second barb 22 through the eyelet 24 to hold the square 12 in place. A bottom portion of the square 12 is pushed through the free moving distal band.

Figure 1:
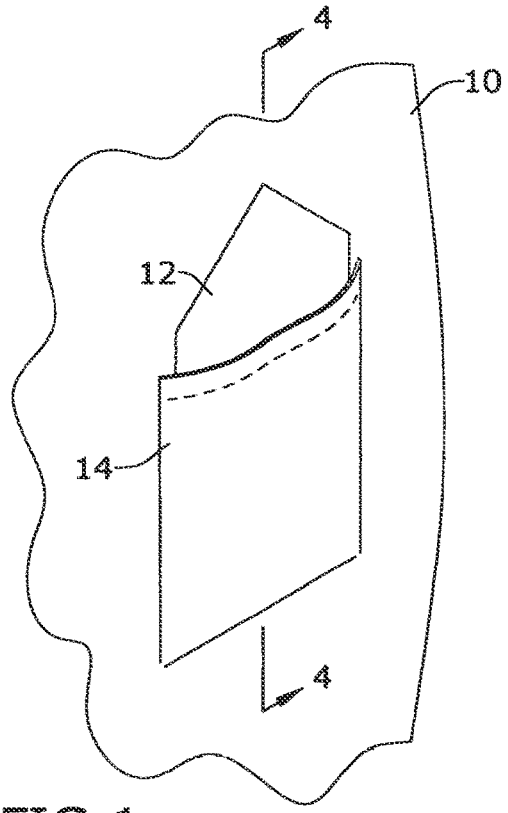
FIG. 1 shows a perspective view of an embodiment of a notch for holding a pocket square in use.
Figure 2:
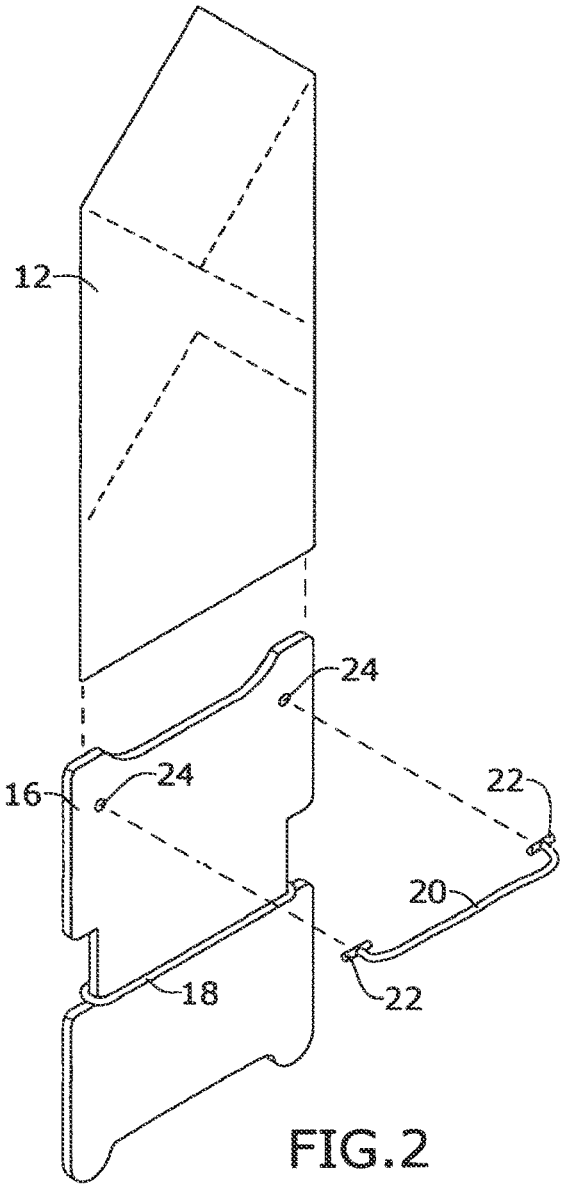
FIG. 2 shows an exploded perspective of an embodiment of the notch for holding a pocket square.
Figure 3:
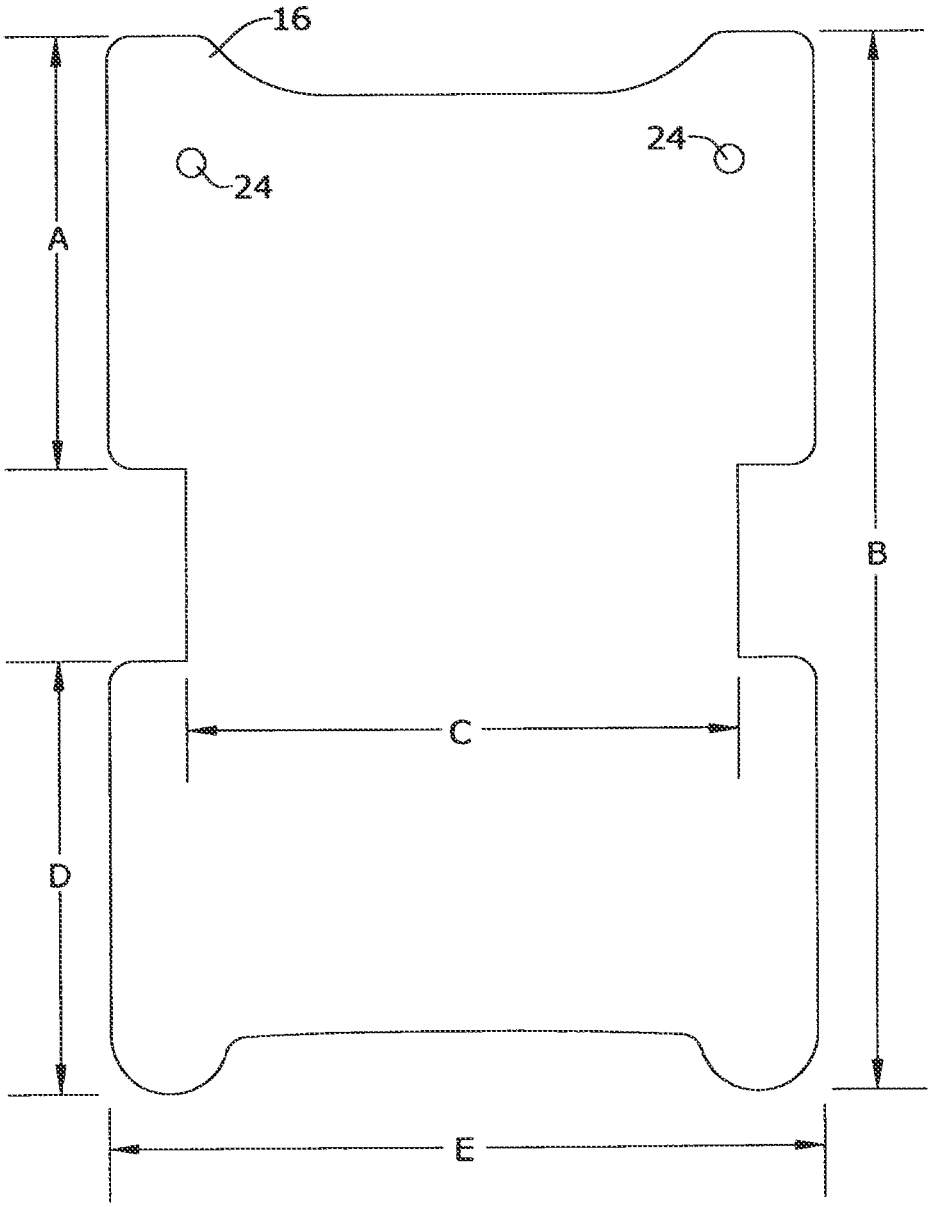
FIG. 3 shows a front elevation view of an embodiment for holding the notch.

As shown in FIGS. 1 and 4 through 7, the notch is then placed in a pocket 14 of an upper garment 10, wherein the holder 16 and joined pocket square 12 are between the upper garment 10 and a liner 26 of the pocket 14. The lose part of the square 12 can be adjusted as desired. FIG. 1 shows an image of the entire notch placed in a pocket 14.

Figure 8:
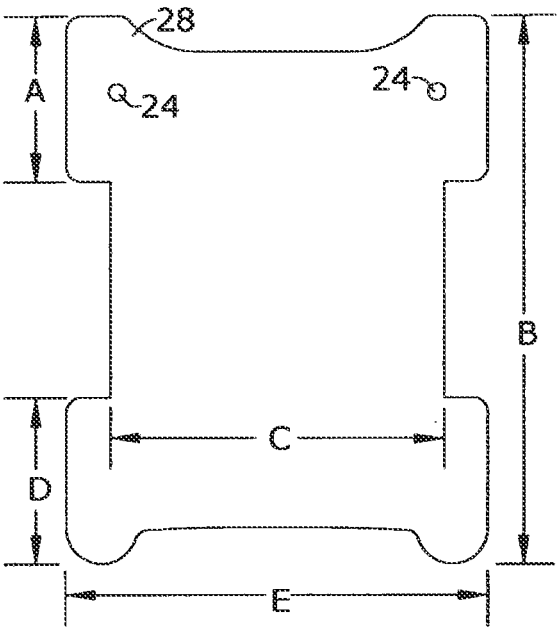
FIG. 8 is a front view of an exemplary embodiment 28 of the notch.
Figure 9:
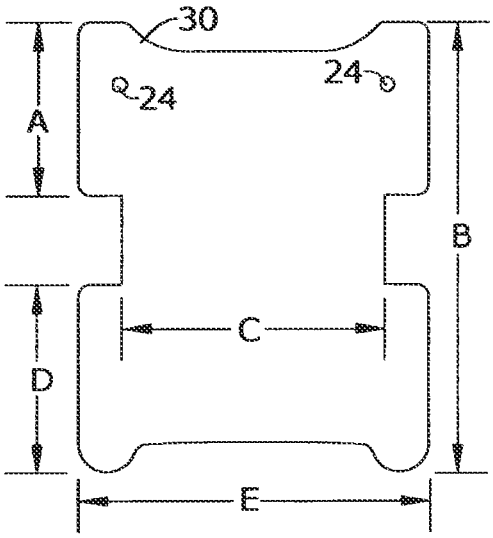
FIG. 9 is a front view of an exemplary embodiment 30 of the notch.
Figure 10:
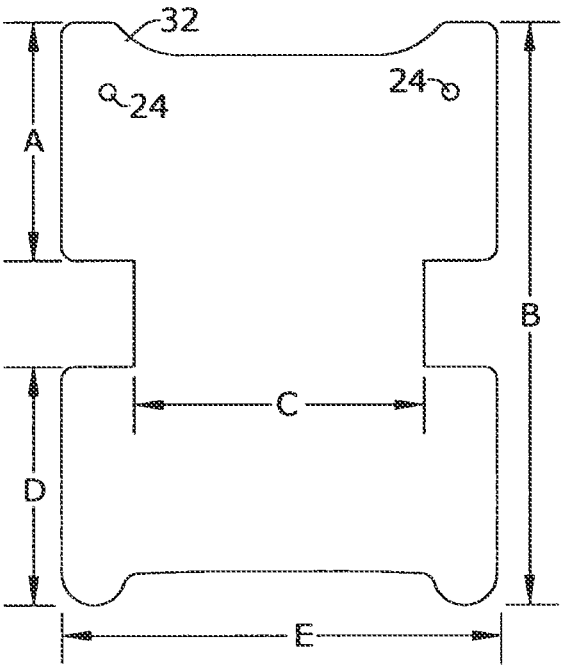
FIG. 10 is a front view of an exemplary embodiment 32 of the present invention.

Referring to FIGS. 8 through 10, the dimensions A, B, C, D, and E can vary between different holders 16, wherein A can range from 1⅜ to 2³⁄₁₆ inches, wherein B can range from 3 to 5½ inches, wherein C and D can range from 1⅜ to 2¹⁵⁄₁₆ inches, and wherein E can range from 2¼ to 3⅝ inches.

In one embodiment, the invention is made by cutting, punching or pouring into a mold.

It should be understood that the size of the notch may vary. It should also be understood that the each or both bands can be separate components from the notch, or fully attached to the notch. Also, the notch may include additional or fewer bands or fasteners.

It should be understood, of course, that the foregoing relates to exemplary embodiments of the invention and that modifications may be made without departing from the spirit and scope of the invention as set forth in the following claims.

What is claimed is:

1. A device for holding a pocket square consisting of:

a firm, rectangular piece of material, the rectangular piece having a proximal end spaced apart from a distal end by a midportion, wherein the proximal end is wider than the midportion, and the distal end is wider than the midportion, and wherein the proximal end, the midportion, and the distal end define an overall outline consisting of a monolithic notch;

a proximal elastic band attached to the proximal end; and a distal elastic band circumscribing the midportion.

* * * * *